US010781975B2

(12) United States Patent
Bassetto et al.

(10) Patent No.: US 10,781,975 B2
(45) Date of Patent: Sep. 22, 2020

(54) LIQUEFIED-FLUID STORAGE TANK

(71) Applicant: L'Air Liquide, Societe Anonyme pour l'Etude et l'Exploitation des Procedes Georges Claude, Paris (FR)

(72) Inventors: Serge Bassetto, Saint Etienne de Crossey (FR); Pierre Briend, Seyssinet (FR)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 126 days.

(21) Appl. No.: 15/759,964

(22) PCT Filed: Aug. 2, 2016

(86) PCT No.: PCT/FR2016/052003
§ 371 (c)(1),
(2) Date: Mar. 14, 2018

(87) PCT Pub. No.: WO2017/046463
PCT Pub. Date: Mar. 23, 2017

(65) Prior Publication Data

US 2018/0259128 A1 Sep. 13, 2018

(30) Foreign Application Priority Data

Sep. 15, 2015 (FR) ..... 15 58629

(51) Int. Cl.
*F17C 9/02* (2006.01)
*F17C 3/04* (2006.01)
(Continued)

(52) U.S. Cl.
CPC ..... *F17C 9/02* (2013.01); *F17C 3/04* (2013.01); *F17C 3/08* (2013.01); *F17C 3/10* (2013.01);
(Continued)

(58) Field of Classification Search
CPC ..... F17C 9/02; F17C 9/04; F17C 3/08; F17C 3/10; F17C 13/001; F17C 2265/033;
(Continued)

(56) References Cited

U.S. PATENT DOCUMENTS 4,285,385 A * 8/1981 Hayashi ..... B22D 18/04 164/112
5,709,203 A * 1/1998 Gier ..... A41D 13/0053 128/201.21
(Continued)

FOREIGN PATENT DOCUMENTS

EP 2 618 038 7/2013
FR 2 927 146 8/2009
(Continued)

OTHER PUBLICATIONS

International Search Report and Written Opinion for PCT/FR2016/052003, dated Jan. 20, 2017.
(Continued)

*Primary Examiner* — Brian M King
(74) *Attorney, Agent, or Firm* — Christopher J. Cronin

(57) ABSTRACT

The invention relates to a liquefied-fluid storage tank including a storage wall the inner surface of which defines a storage volume for liquefied fluid, the tank including an exchanger for cooling the fluid contained in the tank in particular to condense vapors of said fluid. The invention is characterized in that the cooling exchanger includes a body of metal, in particular aluminum, in which at least one pipe of a coolant circuit is integrated in order to cool said body and in that the body is in contact with and attached to the outer surface of the storage wall.

12 Claims, 2 Drawing Sheets

(51) Int. Cl.
*F17C 3/08* (2006.01)
*F17C 3/10* (2006.01)
*F17C 13/00* (2006.01)

(52) U.S. Cl.
CPC .... *F17C 13/001* (2013.01); *F17C 2201/0104* (2013.01); *F17C 2201/032* (2013.01); *F17C 2201/056* (2013.01); *F17C 2203/0304* (2013.01); *F17C 2203/0391* (2013.01); *F17C 2203/0629* (2013.01); *F17C 2221/016* (2013.01); *F17C 2221/05* (2013.01); *F17C 2223/0161* (2013.01); *F17C 2223/033* (2013.01); *F17C 2223/046* (2013.01); *F17C 2225/043* (2013.01); *F17C 2227/0309* (2013.01); *F17C 2227/0341* (2013.01); *F17C 2227/0383* (2013.01); *F17C 2227/0388* (2013.01); *F17C 2260/056* (2013.01); *F17C 2265/012* (2013.01); *F17C 2265/034* (2013.01); *F17C 2270/05* (2013.01)

(58) Field of Classification Search
CPC ..... F17C 2265/034; F17C 2203/03; F17C 2203/0362; F17C 2203/0366; F17C 2203/0387
See application file for complete search history.

(56) References Cited

U.S. PATENT DOCUMENTS 6,012,453 A * 1/2000 Tsals ..... A62B 7/02 128/201.21
2010/0170297 A1* 7/2010 Oka ..... F17C 9/04 62/614

FOREIGN PATENT DOCUMENTS

WO WO 2010 127 671 11/2010
WO WO 2013 167 284 11/2013

OTHER PUBLICATIONS

French Search Report and Written Opinion for FR 1 558 629, dated Jun. 8, 2016.

* cited by examiner

LIQUEFIED-FLUID STORAGE TANK

CROSS-REFERENCE TO RELATED APPLICATIONS

This application is a § 371 of International PCT Application PCT/FR2016/052003, filed Aug. 2, 2016, which claims § 119(a) foreign priority to French patent application FR 1 558 629, filed Sep. 15, 2015.

BACKGROUND

Field of the Invention

The present invention relates to a liquefied fluid storage tank and to a cooling device comprising such a tank.

The invention relates more particularly to a liquefied fluid storage tank comprising a storage wall the inner surface of which defines a storage volume for liquefied fluid, the tank comprising an exchanger for cooling the fluid contained in the tank, in particular for condensing vapors of said fluid.

The invention relates in particular to a cryogenic fluid tank intended to store a gas or gas mixture, in particular xenon or any other atmospheric or other gas, at a low temperature, for example a cryogenic temperature.

Related Art

Cryogenic tanks generally comprise a double-wall structure comprising an air vacuum (for example a pressure of $10^{-4}$ mbar) between the two walls, and a thermal insulator (for example a layer of perlite and/or multilayer insulation).

In particular when the stored gas is relatively expensive, and in order to avoid releasing gas into the atmosphere, it is known to provide a cooling heat exchanger in order to condense the vapors produced in the tank (cf. document EP2618038A).

However, the known solutions increase the complexity, the cost and the bulk of the installations.

SUMMARY OF THE INVENTION

One aim of the present invention is to mitigate all or some of the drawbacks, set out above, of the prior art.

To this end, the tank according to the invention, which otherwise complies with the generic definition given thereof in the above preamble, is essentially characterized in that the cooling exchanger comprises a mass of metal, in particular of aluminum, into which there is integrated at least one pipe of a heat transfer fluid circuit for cooling said mass, and in that the mass is in contact with and attached to the outer surface of the storage wall.

Moreover, embodiments of the invention may include one or more of the following features:

- the mass is in contact with and attached to the outer surface of the upper part of the storage wall,
- the mass is in contact with the storage wall over an area of between 0.04 and 4 $m^2$,
- the mass has a volume representing between 8 and 10 000 kg,
- the mass has a specific heat capacity (density multiplied by heat capacity at constant pressure) of between 7 and 9000 $kJ \cdot m^{-3} \cdot K^{-1}$ and a thermal conductivity of between 180 and 220 $W \cdot m^{-1} \cdot K^{-1}$,
- the mass is linked to the outer wall and pipe(s) by casting metal in liquid form at melting temperature onto the storage wall and around the pipe(s), that is to say that the pipe(s) are embedded in the mass, the mass being overmolded onto the outer wall and the pipes,
- the tank includes at least one metal plate attached to the outer surface of the storage wall and projecting transversely with respect to this wall, the at least one plate comprising at least one curve or cutout, the mass being overmolded onto the outer wall portion comprising the plate(s), that is to say that the plate(s) are embedded in the mass,
- the tank includes an outer wall arranged in a manner spaced around the storage wall, the space between said walls being kept under vacuum at a pressure below atmospheric pressure and comprising a thermal insulation layer,
- the tank includes one or more pipes forming a plurality of loops or zigzags within the mass,
- the plate projecting transversely means that the plate is not completely parallel to the outer surface of the wall, for example the plate is perpendicular to the outer surface of the wall at the location under consideration,
- the tank includes a fluid circuit comprising a pipe for extracting fluid contained within the volume defined by the storage wall and a pipe for returning fluid to the volume defined by the storage wall,
- the extraction pipe comprises an exchanger for heating the extracted fluid, and in that the return pipe comprises a cooling exchanger for fluid returned to the tank,
- the extraction and return pipes are linked to an application or an element for purifying the fluid in the tank by forming a flow loop for the fluid, in which loop the fluid is extracted via the extraction pipe, purified in the purification application or element and returned to the tank via the return pipe.

The invention also relates to a device for cooling a user apparatus by transferring trigones between a liquefied fluid and said user apparatus, the device comprising a liquefied fluid storage tank storing a cryogenic fluid from among: xenon, neon, or any other cryogenic fluid, a circuit for transferring fluid from and to the tank comprising a system of pipes and valves, the tank being in accordance with any one of the features above or hereinafter, the device including a source of heat transfer fluid, such as liquid nitrogen, the at least one pipe of the heat transfer fluid circuit being linked to said heat transfer fluid source.

The invention may also relate to any alternative device or method comprising any combination of the features above or below.

BRIEF DESCRIPTION OF THE FIGURES

Other particular features and advantages will emerge upon reading the following description, given with reference to the figures in which.

DETAILED DESCRIPTION OF THE INVENTION

Figure 1:
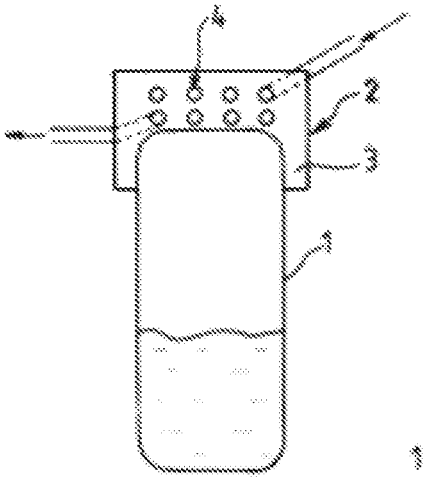
FIG. 1 shows a schematic and partial vertical cross-sectional view illustrating an exemplary implementation of a tank according to the invention.

The liquefied fluid storage tank shown in FIG. 1 comprises, as is conventional, a storage wall 1, for example of generally cylindrical shape, the inner surface of which defines a storage volume for liquefied fluid (cryogenic fluid stored in vapor/liquid equilibrium).

As described hereinafter with reference to FIG. 2, the storage wall 1 may preferably be housed inside an outer wall 5 with an insulation system between the walls 1, 5 (vacuum and thermal insulator layer). The storage wall 1 may also be housed inside a chamber under vacuum or a cold atmosphere that makes it possible to insulate the stored fluid from the heat inputs to the greatest possible extent.

The tank has for example a volume of between 50 and 1000 liters, for example 300 liters. The tank may store in particular xenon in liquid phase at a temperature of −101° C. at 1.5 bar absolute (in biphasic vapor/liquid equilibrium). The tank stores 200 kg of xenon, for example.

The tank comprising an exchanger 2 for cooling the fluid contained in the tank so as to condense the vapors of said fluid.

According to one advantageous particular feature, the cooling exchanger 2 comprises a mass 3 of metal, for example of aluminum, into which there is integrated at least one pipe 4 of a heat transfer fluid circuit for cooling said mass 3. The mass 3 is in contact with and attached to the outer surface of the storage wall 1.

In other words, the vapors present in the store defined by the wall 1 are condensed without having to provide for the vapors to be transferred outside of the storage wall 1.

This arrangement thus forms a condenser that makes it possible to liquefy or reliquefy (or even to solidify) the cryogenic fluid in the tank in a safe and controlled manner without an appended circuit. The 'hot' fluid is not aspirated or directed into an external cooling circuit. The vapors are condensed in situ directly in the tank the storage wall 1 of which is cooled to a controlled temperature and acts as a heat exchange surface.

Likewise, in this arrangement, it is moreover not necessary to provide a condensation exchanger inside the storage wall 1.

As illustrated in the figures, the mass 3 is in contact with and preferably attached to the upper part of the storage wall 1.

This heat exchanger 2 may be welded or cast directly onto the outer face of the storage wall 1. The storage wall 1 (made of stainless steel, steel or any other suitable material) is cooled directly and transmits its frigories to the vapors that it contains.

This creates a condensation process that naturally sets the fluid in motion within the storage volume (in particular if the exchanger is positioned at the upper part). This generates an energy saving.

The exchanger 2 comprises for example one or more coils 4 (tubular pipes) integrated into the mass 3 or matrix having high thermal conductivity. Two parallel circuits of pipes 4 are integrated into the mass 3, for example.

For example, the mass 3 may comprise a solid block of aluminum (or any other suitable metal or alloy).

This mass is passed through (via the pipes 4) by a refrigerant fluid made to flow in ducts 4 implanted therein. This heat transfer fluid may thus extract as many calories at the installed mass 3 and at the wall 1 of the tank as it needs in order to vaporize and heat up to its output temperature.

This architecture significantly improves the flexibility of use of such a tank and in particular of the heat exchanger with respect to the prior art.

The service pressure range of the exchanger is extended significantly in comparison with any other exchanger.

Specifically, it is possible to make this exchanger 2 operate over a very wide temperature range, for example from 4.5 K to 300 K, on account of its great thermal inertia.

Thus, setting this temperature parameter moreover amounts to choosing the desired temperature on the storage wall 1 of the tank (and vice versa).

In the case of storing xenon, preferably, the minimum recommended temperature for the mass is −110° C. (triple point temperature of xenon).

The possible temperature range for the cooled wall 1 hence extends from the value of the triple point of the condensate as far as that given by the maximum admissible pressure. The refrigerant fluid is chosen accordingly.

This heat transfer fluid may be for example liquid nitrogen at −188° C. (85 K), for example at a flow rate of 1 gram per second. At the output of the mass, the nitrogen may be vaporized (temperature of −103° C. (170 K), for example).

The structure of the exchanger also makes it possible to adjust the power of the heat exchange, which power is defined by the difference between the state change temperature of the hot fluid in the tank defined by the wall 1 and the temperature of the mass 3. This power is also dependent on the heat transfer fluid flow rate.

In addition, the heat capacity of the assembly (wall 1 and cooled mass 3) gives the system great thermal inertia. This makes it possible to guarantee temperature stability and therefore pressure stability in the tank. Generally, the large amount of frigories stored within the assembly ensures the thermal stability of the system.

Thus, the invention makes it possible to control and manage the power of the heat exchange. In addition, the invention makes it possible to substantially increase the frigorific energy stored in the materials, thereby making it possible to eliminate the effect of any thermal disturbance.

Depending on the applications, the mass 3 is in contact with the storage wall 1 over an area of between 0.04 and 4 $m^2$.

Likewise, the mass 3 may have a volume representing between 8 and 10 000 kg.

The mass 3 has a heat capacity that may be between 7 and 9000 $kJ \cdot m^{-3} \cdot K^{-1}$ and a thermal conductivity of between 180 and 220 $W \cdot m^{-1} \cdot K^{-1}$.

Figure 5:
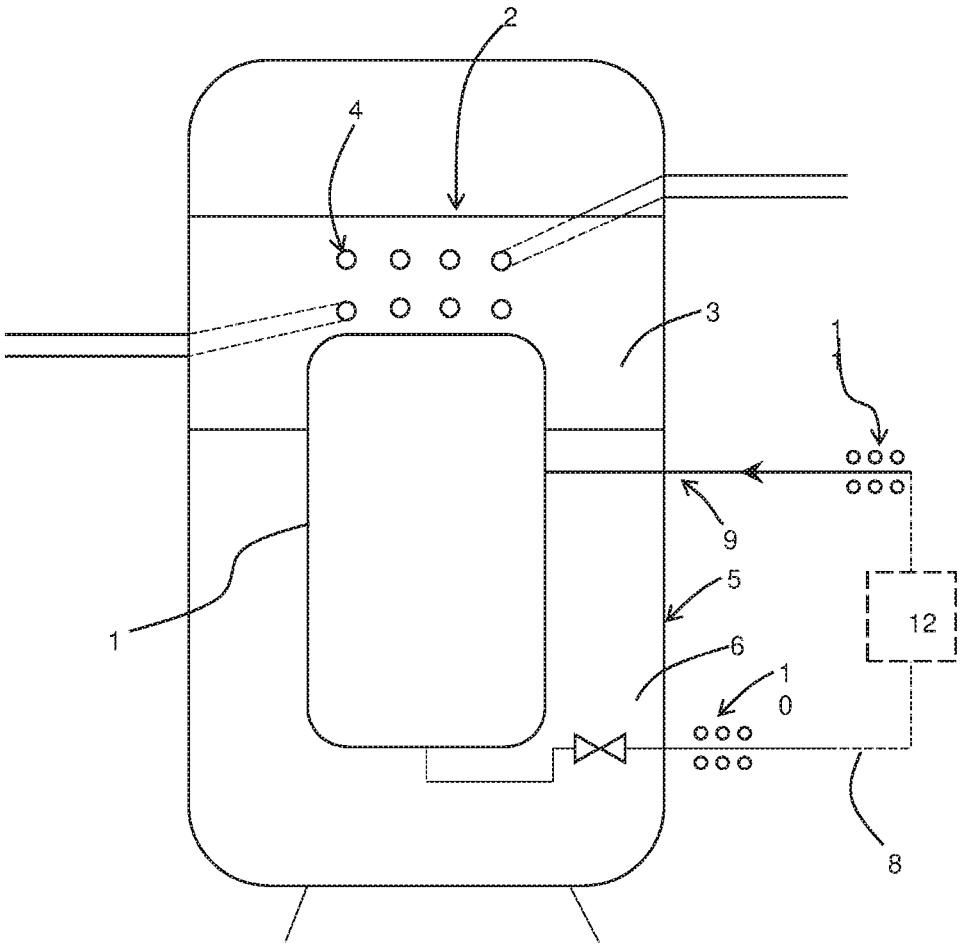
FIG. 5 shows a schematic and partial vertical cross-sectional view illustrating another use of a tank according to the figure in an installation in which the mass of metal is overmolded onto the outer wall and the pipes.

As seen in FIG. 5, mass 3 is preferably linked to the outer wall 1 and to the pipe(s) 4 by casting metal in liquid form at melting temperature onto the storage wall 1 and around the pipe(s) 4. In other words, the pipe(s) 4 are embedded in the mass 3, the mass being overmolded directly onto the outer wall 1 and the pipes 4.

Figure 3:
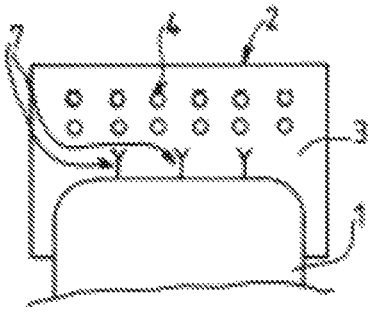
FIG. 3 shows a schematic and partial vertical cross-sectional view of the upper part of a tank of the type in FIG. 1 according to one advantageous embodiment.
Figure 4:
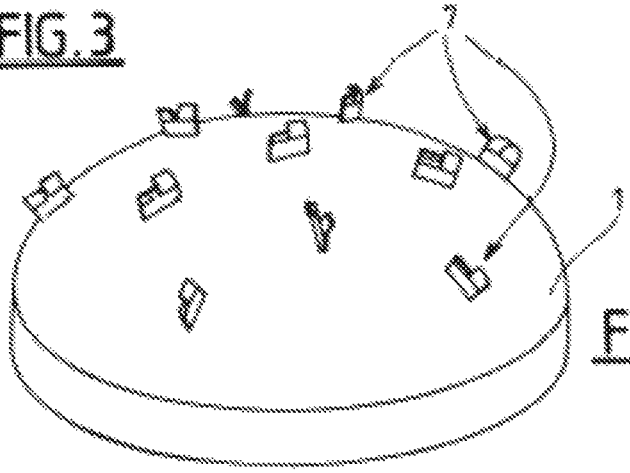
FIG. 4 shows a perspective view of the upper part of the storage wall of the tank of the type in FIG. 1 according to one advantageous embodiment.

As illustrated in FIG. 3, the upper surface of the storage wall 1 may include at least one metal plate 7 attached (for example by welding) to the outer surface of the storage wall 1 and projecting transversely with respect to this wall 1. These plates 7 comprising at least one curve or cutout (cf. FIG. 4). The mass 3 is overmolded onto the outer wall 1 portion comprising the plate(s) 7. The plates 7 are embedded in the mass 3 and, through their non-rectilinear shape (in the shape of a hook for example), ensure a mechanical bond between the mass 3 and the storage wall 7, in particular in the event of differential expansions between these two elements.

Figure 2:
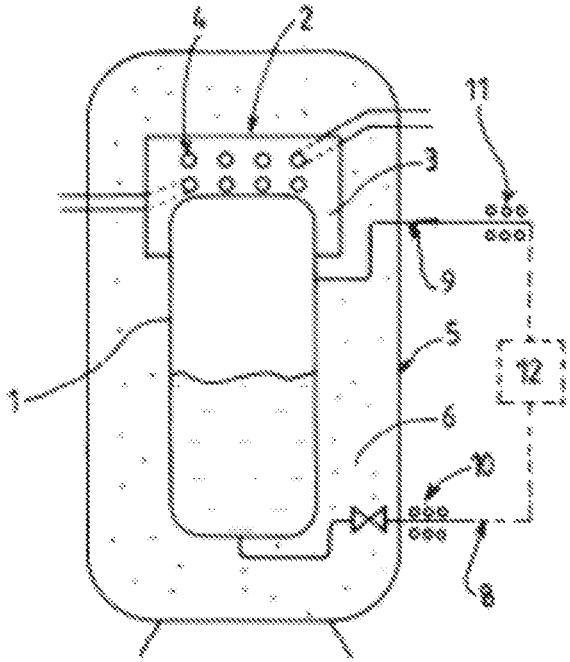
FIG. 2 shows a schematic and partial vertical cross-sectional view illustrating the use of a tank according to the figure in an installation.

As illustrated schematically in FIG. 2, the tank preferably comprises an outer wall 5 arranged in a manner spaced around the storage wall. The space between said walls 1, 5 is kept under vacuum at a pressure below atmospheric pressure and houses a thermal insulation layer 6.

In addition, the tank may include a fluid circuit comprising a pipe 8 for extracting fluid contained within the volume defined by the storage wall 1 and a pipe 9 for returning fluid to the volume defined by the storage wall 1.

These two pipes 9, 8 may be linked to an application or an element 12 for purifying the fluid stored in the tank. If this purification application or element 12 operates at temperatures that are relatively higher than the temperature at which the fluid is stored in the tank, the extraction pipe 8 may comprise an exchanger 10 for heating the extracted fluid and the return pipe 9 may comprise a cooling exchanger 11 for fluid returned to the tank. In other words, the extraction 8 and return 9 pipes are linked to the purification application or element 12 by forming a flow loop for the fluid, in which loop the fluid is extracted and heated (vaporized) via the extraction pipe 8, purified in the purification element and cooled (condensed) and returned to the tank via the return pipe 9.

Of course, the tank may comprise a system of valves, in particular safety valves that are not shown for the sake of simplicity.

While the invention has been described in conjunction with specific embodiments thereof, it is evident that many alternatives, modifications, and variations will be apparent to those skilled in the art in light of the foregoing description.

Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a" an and "the" include plural referents, unless the context clearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A liquefied fluid storage tank comprising a storage wall, an outer wall arranged in a manner spaced around the storage wall, and a cooling exchanger for condensing vapors of the fluid contained in the tank, the inner surface of the storage wall defining a storage volume for the liquefied fluid, the space between said walls being under vacuum at a pressure below atmospheric pressure and comprising a thermal insulation layer, wherein the cooling exchanger comprises a mass of metal into which there is integrated at least one pipe of a heat transfer fluid circuit for cooling said mass of metal, the mass of metal is in contact with and attached to the outer surface of the storage wall, and the mass of metal is linked to the outer wall and to the at least one pipe by casting metal in liquid form at melting temperature onto the storage wall and around the at least one pipe so that the at least one pipe is/are embedded in the mass and the mass of metal is overmolded onto the outer wall and the pipes.

2. The tank of claim 1, wherein the mass of metal is in contact with and attached to an outer surface of the upper part of the storage wall.

3. The tank of claim 1, wherein the mass is in contact with the storage all over an area of between 0.04 and 4 $m^2$.

4. The tank of claim 1, wherein the mass of metal has a volume between 8 and 10 000 kg.

5. The tank of claim 1, wherein the mass of metal has a specific heat capacity of between 7 and 9000 $kJ \cdot m^{-3} \cdot K^{-1}$ and a thermal conductivity of between 180 and 220 $W \cdot m^{-1} \cdot K^{-1}$.

6. The tank of claim 1, further comprising at least one metal plate attached to an outer surface of the storage wall and projecting transversely with respect to the storage wall, wherein the at least one metal plate comprises at least one curve or cutout and the mass of metal is overmolded onto the plate(s) so that the plate(s) are embedded in the mass.

7. The tank of claim 1, further comprising a fluid circuit comprising an extraction pipe adapted and configured to extract fluid contained within the volume defined by the storage wall and a return pipe adapted and configured to return fluid to the volume defined by the storage wall.

8. The tank of claim 7, wherein the extraction pipe comprises an exchanger for heating the extracted fluid and the return pipe comprises a cooling exchanger for fluid returned to the tank.

9. The tank of claim 7, further comprising a fluid purifier adapted and configured to purify the fluid in the tank, wherein the extraction and return pipes linked to the purifier to form a flow loop for the fluid in which the fluid is extracted via the extraction pipe, purified in the purifier, and returned to the tank via the return pipe.

10. The tank of claim 1, wherein the metal is aluminum.

11. A cooling device for cooling a user apparatus by transferring frigories between a liquefied fluid and said user apparatus, the device comprising the liquefied fluid storage tank of claim 1 storing a cryogenic fluid selected from xenon, neon, or other cryogenic fluid and a circuit adapted and configured to transfer fluid from and to the tank that comprises a system of pipes and valves, wherein the cooling device includes a source of heat transfer fluid and the at least one pipe of the heat transfer fluid circuit is linked to the heat transfer fluid source.

12. The cooling device of claim 11, wherein the heat transfer fluid is liquid nitrogen.

* * * * *